United States Patent [19]

Nelson

[11] Patent Number: 4,624,169

[45] Date of Patent: Nov. 25, 1986

[54] APPARATUS FOR AUTOMATED CUTTING OF THIN FILMS

[75] Inventor: Carl Nelson, Anaheim, Calif.

[73] Assignee: Aerochem, Inc., Orange, Calif.

[21] Appl. No.: 720,989

[22] Filed: Apr. 8, 1985

[51] Int. Cl.[4] ..... B26D 3/08

[52] U.S. Cl. ..... 83/881; 33/1 M; 83/71

[58] Field of Search ..... 83/875, 880, 881, 879, 83/71, 368, 72, 74; 33/1 M

[56] References Cited

U.S. PATENT DOCUMENTS

| | | | |
|---|---|---|---|
| 3,668,956 | 6/1972 | Whipple et al. | 83/881 |
| 3,756,104 | 9/1973 | Bier et al. | 83/881 |
| 3,821,910 | 7/1974 | Tjaden | 83/881 |
| 4,391,168 | 7/1983 | Gerber et al. | 83/71 X |
| 4,391,170 | 7/1983 | Boverman et al. | 83/71 |
| 4,426,783 | 1/1984 | Gerber et al. | 33/1 M |
| 4,479,346 | 10/1984 | Chandler | 83/72 X |
| 4,524,894 | 6/1985 | Leblond | 83/875 X |

*Primary Examiner*—Frank T. Yost

*Attorney, Agent, or Firm*—James E. Brunton

[57] ABSTRACT

A method and apparatus for use in chemical milling operations to automatically cut a maskant material, such as a thin film of plastic, which has been applied to the workpiece. The cutting device of the invention is designed for use with a computer controlled apparatus embodying a rectilinear robot adapted to move the cutting device in first, second and third directions relative to the workpiece. The pressural engagement between the cutting blade of the device and the workpiece is continuously sensed and controlled. Additionally, the angle between the cutting blade and the maskant is controllably varied as the cutting device is moved by the rectilinear robot.

5 Claims, 5 Drawing Figures

FIG. 1
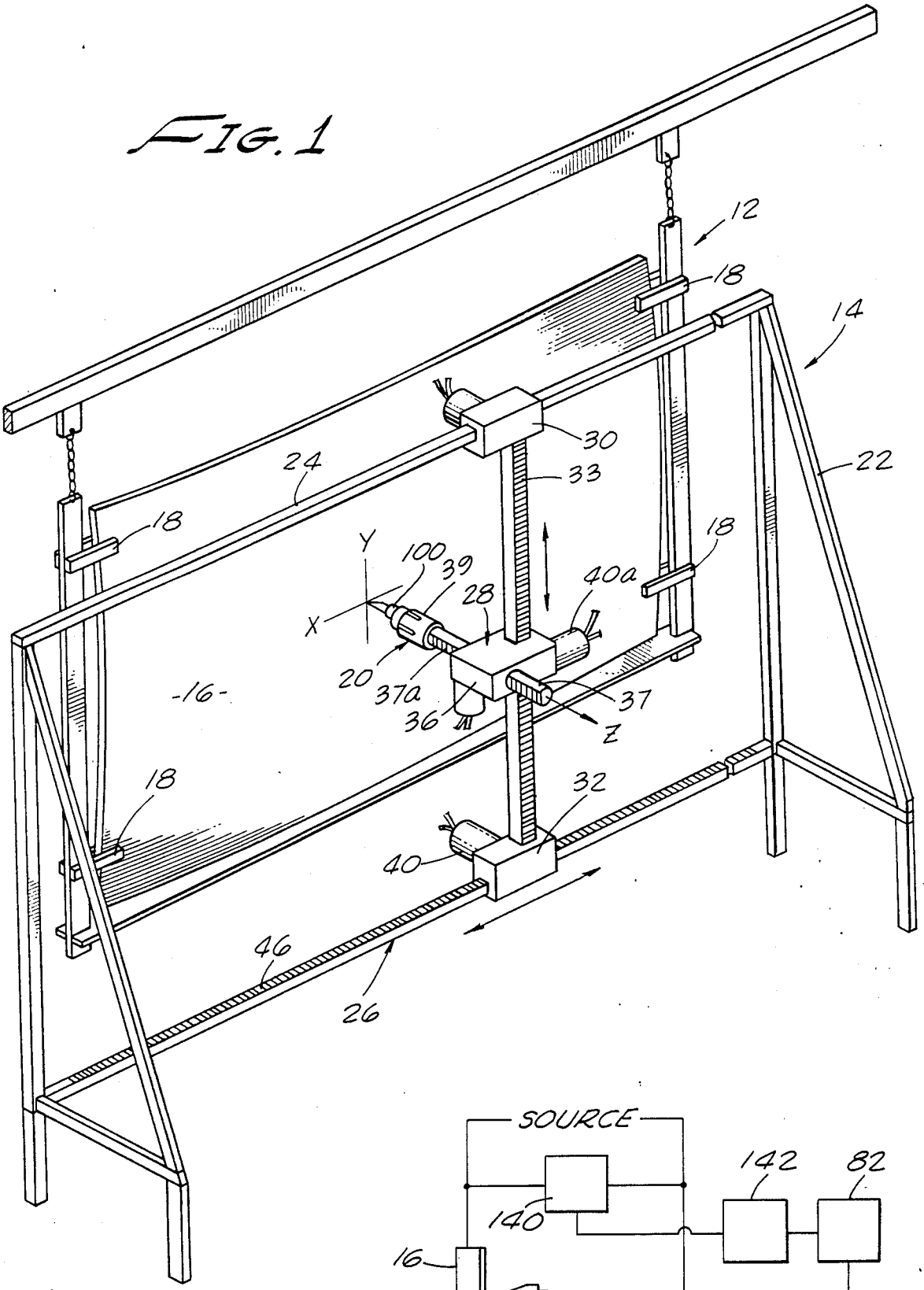
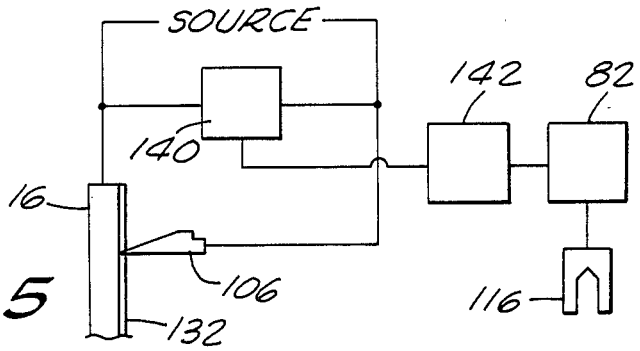
FIG. 5

APPARATUS FOR AUTOMATED CUTTING OF THIN FILMS

BACKGROUND OF THE INVENTION

1. Field of the Invention

The present invention relates generally to methods and apparatus for use in chemical milling of metallic materials. More particularly the invention concerns a unique method and apparatus for automatically cutting a maskant material, such as a thin film of plastic, which has been applied to the metal workpiece to be milled.

2. Discussion of the Prior Art

Chemical milling may be defined as a process of etching the surfaces to be milled by chemical attack. The techniques for chemical milling of metallic workpieces are well known and have proven particularly useful in the past for applications wherein it is desired to remove specific amounts of material in predefined areas of aluminum, magnesium, titanium or steel sheet material after the sheet has been either rolled or stretch formed. As a practical matter, it is not feasible to mechanically mill large sections of sheet material, and particularly sheet material having a compound curved surface, due to equipment limitations and great expense. However, in many applications, including aerospace applications, where part weight and wall thickness tolerances are critical, precision milling of large sheet metal components is frequently required. Chemical milling has proven quite valuable and is widely used in such applications.

The standard approach followed in the past in chemical milling sheet workpieces to a uniform wall thickness was to first measure the wall thickness of the part at a multiplicity of points. The wall thickness data thus obtained was then used to draw contour lines on the surface of the part which represented regions of greater and lesser wall thickness.

After the contour lines were drawn on the surface of the part, the next step in the prior art procedures was to cover the surface of the part with a thin film of vinyl plastic, gelatin, rubber base material, or other etch-proof film, or maskant. This was done by spraying, painting, dipping or otherwise applying the maskant to the surface of the part. Due to the substantial transparency of the maskant, the contour lines drawn on the part surface remained visible. Next, using a sharp knife or razor blade, a portion of the maskant was cut away by hand as, for example, along the contour lines of an area of greater wall thickness. The part was then immersed into the etching bath which comprised acid, a suitable caustic, or other chemical attacking means. Since the maskant protected all the surface save the unprotected area, only this area would be attacked by the chemical and would be milled away. Successive steps of cutting away the maskant from other portions of the part, reimmersing of the part into the etching bath and continued gaging of the etched areas permitted precise milling of the surface of the part to a desired uniform wall thickness. A typical prior art technique for chemical milling using a polyvinyl maskant is described in U.S. Pat. No. 2,739,047 issued to Manuel C. Sanz.

Particularly with large parts, the time required to gage and mark the surface areas to be etched was highly labor intensive, often involving many man hours. Similarly, the time required to then manually cut the maskant was inordinately large.

One of the most significant advancements in chemical milling over the prior techniques as described in the preceding paragraphs is disclosed in co-pending application Ser. No. 06/542,790, now Pat. No. 4,523,973, filed by the present inventor. In this application there is disclosed an improved and highly unique method and apparatus for automatically measuring, scribing, chemically milling and inspecting sheet metal workpieces. In the preferred form of the apparatus of the invention described in this application, maskant cutting is accomplished by a laser technique.

The present invention contemplates the use of equipment similar to that described in the aforementioned co-pending application, but provides a unique alternative mechanism for cutting the maskant material. More particularly the apparatus of the present invention, instead of embodying a laser device for cutting the maskant, involves the use of a novel maskant cutting apparatus which embodies a sharp cutting blade adapted to be automatically advanced along a predetermined contour line in a constant, controlled light contact with the surface of the metal workpiece.

The maskant cutting apparatus of the present invention can also be used in conjunction with simplified motion generating devices which function to move the tool holder only in first and second directions relative to the workpiece.

SUMMARY OF THE INVENTION

It is a primary object of the present invention to provide a novel and highly cost effective method and apparatus for chemically milling large sheet metal workpieces and the like to uniform wall thickness in which all cutting of the protective maskant used to initially cover the part is accomplished automatically and with extreme precision through the use of a unique, sensor controlled cutter assembly which is operably coupled with a motion generating rectilinear robot.

More specifically it is an object of the invention to provide a method and apparatus of the aforementioned character which is markedly superior to the conventional prior art manual techniques of chemical milling and one which minimizes processing times, permits substantial savings in labor and at the same time markedly decreases the chances for operator error.

In particular, it is an object of the present invention to provide a novel maskant cutting device adapted for use with a computer controlled apparatus adapted for automatic chemical milling of large sheet metal parts to specified wall thicknesses. Such an apparatus is of the character described in U.S. Pat. No. 4,523,973 in which a maskant covered part is first gaged using a rectilinear robot and an ultrasonic sensor to determine the precise wall thickness of the part at a multiplicity of locations. The data thus obtained is entered into a host computer which has been programmed to develop a surface contour plot of the thick and thin areas of the part. After measurement is complete, the ultrasonic sensor is replaced by the cutting device of the present invention. The computer is then operably coupled with the robot to drive the robot in a manner to cause the cutting device to transverse one or more of the previously defined contour lines so as to cut accurately the maskant along such lines. Following the cutting of the maskant along the selected contour lines, the maskant is stripped away from the thickest areas, all other lines are sealed, and the part is immersed in the etching bath to remove material in the unprotected areas. The part is then rinsed and the maskant stripping process is repeated. Through successive repetitions of the process, the part can be precisely milled to the desired wall thickness. The maskant cutter, is then replaced with the ultrasonic sensor and the part is finally inspected to assure compliance with specifications.

It is another object of the invention to provide an apparatus of the character described in the preceding paragraphs in which the cutter device includes a stepping motor for rotating the cutter blade about the axis of the tool holder to enable precise movement of the blade relative to the workpiece whereby the blade will precisely follow the predetermined contour lines. The apparatus also includes a solenoid, a sensor and associated circuitry for sensing the amount of pressural contact between the cutting blade and the workpiece and for precisely regulating this pressure within a predetermined range by controllable energization of the solenoid.

A further object of the invention is to provide an apparatus of the character described in which both large planar sheet metal sections as well as large sheet metal sections having compound curved surfaces can be processed.

These and other important objects of the invention will become apparent from the description which follows.

DESCRIPTION OF THE DRAWINGS

FIG. 1 is a generally perspective view of the apparatus of the invention including a workpiece holding structure and a rectilinear robot mechanism adapted to perform various processing operations on the workpiece.

FIG. 5 is a generally schematic view illustrating one form of the second sensor means of the invention for controlling pressural contact between the maskant cutter blade and the workpiece.

DESCRIPTION OF THE INVENTION

Figure 2:
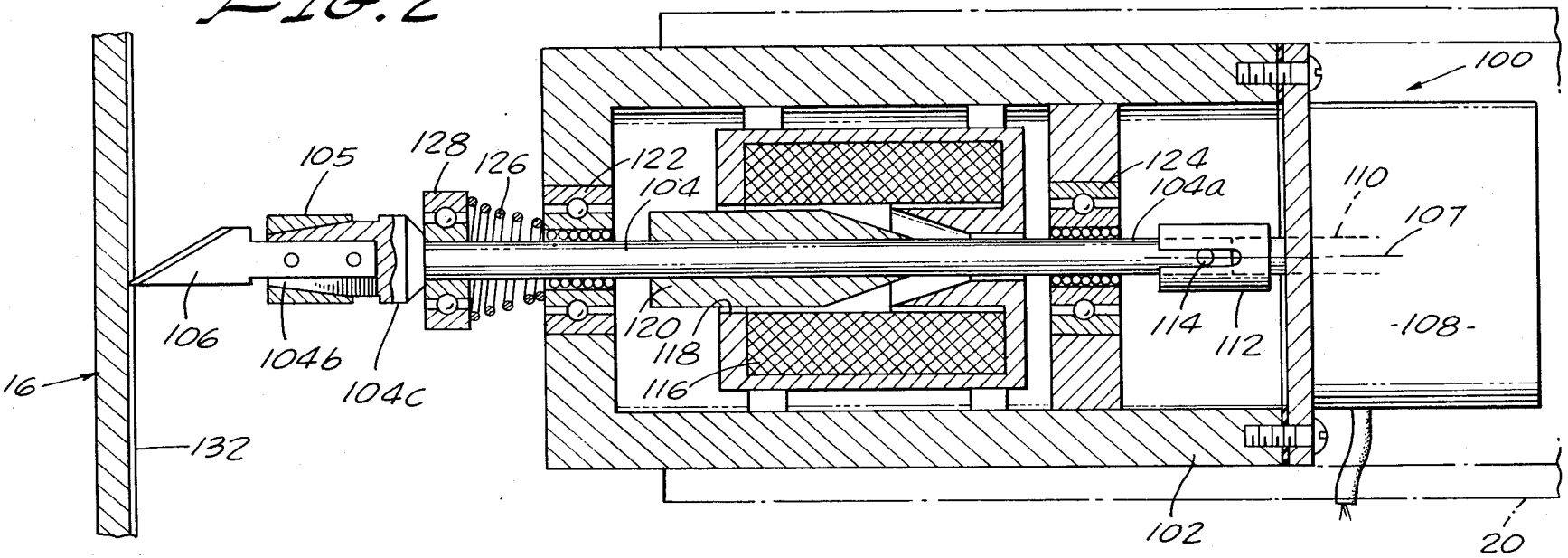
FIG. 2 is a greatly enlarged, side elevational, cross-sectional view of the maskant cutter assembly of one embodiment of the invention.

Referring to the drawings and particularly to FIG. 1, the apparatus of the present invention, which is adapted for use in connection with the chemical milling of workpieces, comprises a workpiece supporting frame 12 and a rectilinear robot apparatus, generally designated by the numeral 14. In the form of the invention shown in the drawings, the workpieces to be addressed are large, thin, generally planar, or alternatively, compound curved plates 16 which are held in a generally vertical orientation by the supporting frame 12. The workpiece 16 may be aluminum, magnesium, titanium, steel or other metal sheet material which has either been rolled or stretch formed to the approximate shape required for the particular end product use.

The workpiece 16 in its unprocessed form is typically of non-uniform wall thickness and must be processed by chemical milling techniques to achieve a final product of generally uniform wall thickness. The final product specifications may also require engineering features such as ribs, relief portions or the like which are also preferably formed by chemical milling techniques. Part 16 is precisely indexed within the supporting frame 12 through the use of known means such as tooling holes, or clamps, 18 which repeatedly index the part into a desired orientation. In this way the part can periodically be removed for chemical etching and then be replaced for further processing within supporting frame 12 in precisely the same position each time.

The robot apparatus 14 of the present invention comprises a tool holder 20 and first, second and third means for moving the tool holder rectilinearly in first, second and third directions respectively relative to the workpiece 16. More particularly, these means function to move the tool holder, and the tool connected thereto, along the X, Y and Z axes of the apparatus as identified in FIG. 1. As shown in FIG. 1, the robot apparatus here considered comprises a support structure 22, first and second spaced apart generally horizontally extending tracks 24 and 26 carried by the support structure and a carriage 28 reciprocally movable along tracks 24 and 26. Carriage 28 comprises upper and lower housings 30 and 32 and a vertically extending track 33 interconnecting said housings. A shuttle means, including a housing 36, is carried by the vertically extending track 33 and is adapted for vertical reciprocal movement therealong.

Figure 3:
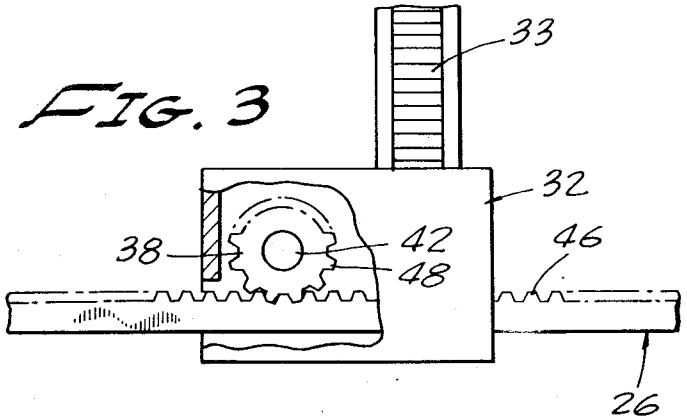
FIG. 3 is a greatly enlarged, fragmentary side elevational view partly in cross-section illustrating the construction of the drive mechanism of the robot which is used to controllably drive the working tool of the apparatus in various directions with respect to the surface of the workpiece.

Housings 30 and 32 function to enclose a first drive means of the general character illustrated in FIG. 3 for controllably driving the carriage 28 to and fro along tracks 24 and 26. Similarly housing 36 functions to enclose a second drive means adapted to drive the shuttle means reciprocally along track 33. Housing 36 also functions to support a tool holding means and a third drive means adapted to move the tool holding means along a straight line toward and away from the workpiece 16.

The tool holding means of the instant form of the invention comprises an elongated member 37 and a connector 39 adapted to carry the maskant cutter assembly of the present form of the invention.

Referring to FIG. 3, which is a fragmentary crosssectional view of housing 32 and the first drive means housed therewithin, the drive means in this form of the invention comprises a pinion gear 38 which is rotatably driven by a direct current stepping motor 40 (FIG. 1) through a shaft 42. The first drive means shown in FIG. 3 is typical of the construction of the second and third drive means as well. Similarly, in the present form of the invention each of the tracks 24, 26 and 32 is provided in the form of elongated rack members of the type identified in FIG. 3 by the numeral 26. Each of the racks, which comprise the track portions of the invention, are provided with upstanding teeth 46 which operably engage the teeth 48 formed on the pinion gear 38. With this construction it is apparent that clockwise rotation of pinion gear 38 as viewed in FIG. 3 will cause housing 32, along with vertical track 33, to move to the right as viewed in FIG. 3. The drive means which is housed in upper housing 30 is preferably driven synchronously with the drive means illustrated in FIG. 3 so that the entire carriage 28 will move uniformly along tracks 24 and 26 in a direction determined by the direction of rotation of the pinion gears 38. In similar fashion, housing 36 of the shuttle means, along with the tool holder means, will be driven up or down by a pinion gear interengaging the upstanding teeth formed on track 33. The third drive means of the invention also comprises a pinion gear adapted to operably engage teeth 37*a* formed on elongated member 37 of the tool holding means of the invention. With this construction, rotation of the pinion gear by a stepping motor 40*a* will cause reciprocal movement of the tool holding means rectilinearly toward and away from the workpiece 16.

Figure 4:
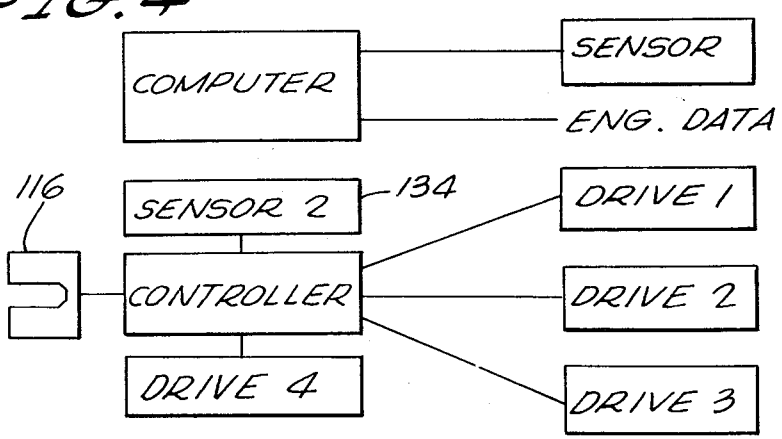
FIG. 4 is a block diagram illustrating the interrelationship between the major control component parts of the apparatus of the invention.

The details of the construction and operation of the rectilinear robot, its interface with a host computer, and the methods for measuring the wall thickness of a given workpiece are described in detail in U.S. Pat. No. 4,523,973 and will not be repeated herein. However, for sake of clarification, it is to be noted that, as shown in FIG. 4, a host computer 80 is interfaced with a controller 82 which, in turn, controls drives 1, 2 and 3. More particularly, in the practice of the invention, the host computer 80 receives measurement information from an ultrasonic sensor means (sensor 1), the details of construction and operation of which are described in U.S. Pat. No. 4,523,973. The host computer also receives engineering data which defines the engineering features required on a particular workpiece. With this information appropriately entered into the host computer, the computer will then interface with the controller in a manner to selectively drive the tool holder 39 in first, second and third directions relative to the workpiece 16.

Referring now to FIG. 2, the maskant cutter assembly of the invention, which is adapted to be removably carried by tool holder 20, is generally designated by the numeral 100 (see also FIG. 1). In the present embodiment of the invention, this assembly comprises a support frame 102, an elongated axially extending electromagnetically energized member 104 having first and second ends 104*a* and 104*b*, and a maskant cutter blade 106 removably connected to second end 104*b* of member 104 by means of a collet assembly 105. Member 104 is mounted within frame 102 for rotation about its longitudinal axis (indicated in FIG. 2 by the numeral 107).

A first drive means, provided here in the form of an electrically operated stepper motor 108, functions to controllably rotate member 104 about axis 107 to enable the cutting angle of blade 106 to be controllably varied relative to workpiece 16. Stepper motor 108 is provided with a drive shaft 110 which is operably coupled with the first end 104*a* of member 104 by means of a slotted drive coupling 112 which is adapted to drivably engage a transversely extending pin 114 provided on member 104. As indicated in FIG. 4, stepper motor 108, identified as Drive 4 in FIG. 4, is operably associated with controller 82 and is operated thereby in accordance with information received from computer 80.

A second drive means is provided for controllably moving member 104 relative to the workpiece 16 between a first extended position and a second retracted position. In the embodiment of the invention shown in the drawings, this second drive means comprises a generally cylindrically shaped electromagnetic coil 116 carried by support frame 102. Coil 116 is provided with an axially extending central bore 118 which is adapted to closely receive an enlarged diameter armature portion 120 carried by member 104 intermediate its ends 104*a* and 104*b*. Armature 120 may be integrally formed with member 104 or, as indicated in FIG. 2, it may comprise a separate ferromagnetic component which is affixed to member 104 proximate the central portion thereof. Armature 120 is normally positioned at least partially within bore 118 of coil 116 so that upon energization of coil 116 it will be acted upon to move member 104 relative to frame 102.

To enable both axial and rotational movement of member 104 with respect to frame 14, there is provided first and second axially spaced apart bearing assemblies 122 and 124. Bearing assemblies 122 and 124 are combination ball and lineal bearings and are adapted to closely receive member 104 in the manner illustrated in FIG. 2.

Also forming a part of the maskant cutting assembly of the present invention is biasing means associated with elongated member 104 for yieldably resisting movement thereof between the first extended and the second retracted positions. In the embodiment of the invention shown in the drawings, this biasing means comprises a coil spring 126 which is disposed between combination bearing 122 and a ball bearing 128 which is affixed to member 104 proximate an enlarged diameter portion 104*c* located near second end 104*b*. As will be discussed in greater detail in the paragraphs which follow, spring 126 functions to yieldably resist movement of elongated member 104 to the right, as viewed in FIG. 2, upon energization of electromagnetic coil 116. This movement of elongated member 104 enables the precise adjustment of the cutting blade 106 with respect to the workpiece 16 and the thin film of maskant identified in FIG. 2 by the numeral 132.

It is to be understood that various types of biasing means can be used to control the movement of member 104 relative to the workpiece. For example, a second solenoid unit of standard design could be mounted on frame 102 and be adapted to controllably counteract the movement of member 104 caused by the activation of coil 116. Similarly, other types of springs and comparable mechanical devices well known to those skilled in the art can be used to yieldably resist the movement of member 104 between its first and second positions.

Forming an important aspect of the present invention is a second sensor means operably associated with electromagnetic coil 116 for sensing the amount of pressural contact between cutter blade 106 and the workpiece 16, and for controllably energizing and de-energizing coil 116 to continuously maintain a predetermined amount of pressural contact between blade 106 and workpiece 16. In FIG. 4, this second sensor means is identified by the numeral 134 and, as shown in FIG. 4, is disposed in operable association with the previously mentioned controller 82.

The second sensor means, or sensor 134, can be provided in several configurations well known to those skilled in the art. For example, as depicted in FIG. 5, the sensor can take the form of an electrical system comprising a resistance measuring device 140, an amplifier 142 and a current source adapted to cause a flow of current between blade 106 and workpiece 16. The electrical system can be operably associated with controller 82 and coil 116 so that when electrical contact is made between the blade and the workpiece a feed back signal will be supplied to the controller which will energize and de-energize the coil 116 in a manner to continuously maintain a low effective resistance at the junction of the blade and the metal. In this way, the amount of pressure exerted by the blade against the metal can be closely regulated to insure clean cutting of the maskant without resultant damage to the workpiece.

The sensor means of the invention can also take on other forms well known to those skilled in the art. For example, a pressure transducer of standard commercial design can be used to measure the amount of pressure exerted on the workpiece by blade 106 and can be suitably interconnected with the controller 82 so that controller 82 will operate coil 116 in a manner to continuously maintain a predetermined pressural contact between blade 106 and workpiece 130.

OPERATION

Once the contour data has been obtained and programmed into the computer in the manner described in U.S. Pat. No. 4,523,973, the computer will be capable of readily commanding the controller to drive the first, second third and fourth drive means in a manner to accomplish the expeditious movement of the tool holder 20 and the maskant cutting blade along the contour lines defined in and selected by the computer. The maskant cutting assembly 100 is then mounted in the tool holder 20 and maskant cutting can begin.

The cutting assembly 100 is carried within the tool holder 20 in close proximity with the workpiece so that as it is moved by the first, second and third drives spring 126 will normally urge the blade into pressural contact with the surface of the workpiece. However, as previously discussed, when contact is made between the blade and the workpiece, a feed back signal will be supplied through the amplifier 142 to the controller 82. The controller will then controllably energize the coil 116 in a manner such that the blade will be continuously positioned relative to the workpiece so as to maintain a predetermined low effective resistance at the junction of the blade and the workpiece. In this way, as the tool holder moves along a given contour line, the blade will cleanly cut the maskant without damaging the workpiece.

To further expedite the smooth cutting of the maskant, controller 82 is adapted to control stepper motor 108 (Drive 4) in accordance with information derived from the host computer so as to cause the appropriate degree of rotation of member 104 and blade 106 relative to the work piece. In this way as the tool holder 20 is moved relative to the workpiece by drives 1, 2 and 3 so as to follow a given contour line, the blade will be rotated relative to the workpiece by drive 4 in a manner to continuously maintain an optimum cutting angle between the blade and the maskant.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An improved apparatus for controllably cutting a thin film of maskant material covering a workpiece to be chemically milled, said apparatus including a holder for supporting a maskant cutter assembly, a first means for moving said holder in a first direction relative to the workpiece, a second means for moving said holder in a second direction relative to the workpiece, a third means for moving said holder in a first direction relative to the workpiece, and a supporting means for supporting the workpiece in close proximity with said holder, the improvement comprising a maskant cutter assembly comprising:

(a) a support frame;

(b) an electromagnetic element carried by said support frame;

(c) an electromagnetically energized member carried by said frame and adapted for rotation about its longitudinal axis, said member having first and second ends and a central armature portion disposed at least partially within said electromagnetic element, said member being reciprocally movable relative to said frame between a first position and a second position upon energization of said electromagnetic element;

(d) biasing means associated with said electromagnetically energized member for yieldably resisting movement thereof from between said first and second positions;

(e) a maskant cutter blade removably connected to said second end of said electromagnetically energized member;

(f) an electric motor means carried by said frame and operably associated with said electromagnetically energized member for controllably rotating said electromagnetically energized member about its longitudinal axis; and (g) sensor means operably associated with said electromagnetic element and said cutter blade for sensing the amount of pressural contact between said cutter blade and said workpiece and for controllably energizing said electromagnetic element to continuously maintain a predetermined amount of pressural contact between said blade and said workpiece.

2. An improved apparatus as defined in claim 1 in which said electromagnetic element comprises a generally cylindrically shaped electromagnetic coil.

3. An improved apparatus as defined in claim 2 in which said electromagnetically energized member comprises an elongated axially extending member said central armature portion thereof being disposed at least partially within said coil.

4. An improved apparatus as defined in claim 3 in which said electric motor means comprises a stepped motor.

5. An improved apparatus for controllably cutting a thin film of maskant material covering a workpiece to be chemically milled, said apparatus including a holder for supporting a maskant cutter assembly, a first means for moving said holder in a first direction relative to the workpiece, a second means for moving said holder in a second direction relative to the workpiece, a third means for moving said holder in a first direction relative to the workpiece, and a supporting means for supporting the workpiece in close proximity with said holder, the improvement comprising a maskant cutter assembly comprising:

(a) a support frame;

(b) a generally cylindrically shaped electromagnetic coil carried by said support frame to define an axially extending passageway;

(c) an elongated, axially extending electromagnetically energized member carried by said frame and adapted for rotation about its longitudinal axis, said member having first and second ends and a central armature portion disposed at least partially within said passageway of said coil, said member being reciprocally movable relative to said frame between a first position and a second position upon energization of said coil;

(d) biasing means associated with said member for yieldably resisting movement thereof from between said first and second positions;

(e) a maskant cutter blade removably connected to said second end of said elongated member;

(f) an electric stepping motor carried by said frame having a drive shaft operably connected to said first end of said elongated member for controllably rotating said member about its longitudinal axis; and (g) sensor means operably associated with said electromagnetic coil and said cutter blade for sensing the amount of pressural contact between said cutter blade and said workpiece and for controllably energizing said coil to continuously maintain a predetermined amount of pressural contact between said blade and said workpiece.

* * * * *